US009759399B2

(12) United States Patent
Suzuki et al.

(10) Patent No.: US 9,759,399 B2
(45) Date of Patent: Sep. 12, 2017

(54) VEHICULAR LIGHTING

(71) Applicant: ICHIKOH INDUSTRIES, LTD., Isehara-shi, Kanagawa-ken (JP)

(72) Inventors: Eiji Suzuki, Isehara (JP); Takuji Harao, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 0 days.

(21) Appl. No.: 14/914,882

(22) PCT Filed: Aug. 28, 2014

(86) PCT No.: PCT/JP2014/072537

§ 371 (c)(1),
(2) Date: Feb. 26, 2016

(87) PCT Pub. No.: WO2015/030096

PCT Pub. Date: Jun. 5, 2015

(65) Prior Publication Data

US 2016/0215945 A1 Jul. 28, 2016

(30) Foreign Application Priority Data

Aug. 29, 2013 (JP) ..... 2013-178221

(51) Int. Cl.
*F21S 8/10* (2006.01)

(52) U.S. Cl.
CPC ..... *F21S 48/1258* (2013.01); *F21S 48/1159* (2013.01); *F21S 48/1283* (2013.01); *F21S 48/1275* (2013.01)

(58) Field of Classification Search
CPC . F21S 48/1159; F21S 48/1258; F21S 48/1283
See application file for complete search history.

(56) References Cited

U.S. PATENT DOCUMENTS

2007/0058386 A1* 3/2007 Albou ..... F21S 48/1159 362/520
2009/0310353 A1 12/2009 Inaba
2011/0199777 A1* 8/2011 Naganawa ..... F21S 48/1159 362/539

(Continued)

FOREIGN PATENT DOCUMENTS

EP 2 657 593 A2 10/2013
EP 2 682 671 A2 1/2014

(Continued)

*Primary Examiner* — Thomas M Sember
(74) *Attorney, Agent, or Firm* — Foley & Lardner LLP

(57) ABSTRACT

There are instances of vehicular lighting in prior art where a significant amount of effectively distributed light radiating from a projection lens is lost. The invention is provided with a semiconductor-type light source (2) and a projection lens (3). The projection lens (3) has an optically active portion (32) transmitting light from the semiconductor-type light source (2), and an optically inactive portion (33). The optically inactive portion (33) of the projection lens (3) is provided with a trimmed portion (33U, 33D) resulting from cutting away a portion of a base shape. As a result, the invention allows the amount of loss in the effectively distributed light radiating from the projection lens (3) to be as small as possible.

10 Claims, 6 Drawing Sheets

(56) References Cited

U.S. PATENT DOCUMENTS

2012/0155103 A1 6/2012 Okada et al.

FOREIGN PATENT DOCUMENTS

| | | | |
|---|---|---|---|
| EP | 2 799 761 | A2 | 11/2014 |
| JP | 2006-222038 | A | 8/2006 |
| JP | 2011-165600 | A | 8/2011 |
| JP | 2011-243474 | A | 12/2011 |
| JP | 2012-114051 | A | 6/2012 |

* cited by examiner (A)

(B)

VEHICULAR LIGHTING

TECHNICAL FIELD

The present invention relates to a vehicular lighting which is provided with: a semiconductor-type light source; and a projection lens in which a trimmed portion resulting from cutting away a part of a basic shape is provided.

BACKGROUND ART

Vehicular lightings of such a type are conventionally known (for example, Patent Literature 1 and Patent Literature 2). A vehicular lighting of Patent Literature 1 is provided with: an incandescent light emitting diode; and a projection lens forming a substantially semicircular shape as a shape of a front view in which there is provided a trimmed portion resulting from cutting away a portion upper than an optical axis, a basic shape of which is a circular shape in a front view, whereas the vehicular lighting is also capable of enhancing a degree of freedom for a design line of a vehicle. A vehicular lighting of Patent Literature 2 is provided with: an incandescent light emitting diode; and a projection lens forming a substantial drum shape (or a barrel shape) as a shape of a front view in which there is provided a trimmed portion resulting from horizontally cutting away each of the upper and lower end parts, a basic shape of which is a circular shape in a front view, whereas the vehicular lighting is also capable of enhancing a degree of freedom for a layout by reducing a space which is occupied by the projection lens.

CITATION LIST

Patent Literature

Patent Literature 1: Japanese Unexamined Patent Application Publication No. 2011-165600

Patent Literature 2: Japanese Unexamined Patent Application Publication No. 2011-243474

Patent Literature 3: Japanese Unexamined Patent Application Publication

SUMMARY OF THE INVENTION

Problems to be Solved by the Invention

However, in so far as the conventional vehicular lightings each are concerned, the trimmed portion resulting from merely cutting away a part of the basic shape is provided in the projection lens; and therefore, there may be a case in which, of the projection lens, a portion that transmits light from a light source (an optical active portion or a portion which is optically active) is significantly lost (cut away) by the trimmed portion. In this case, there may be a case of an increase of the amount of loss in the effectively distributed light that is radiated from the projection lens. That is, there may be a case in which the light from the light source cannot be effectively controlled to be optically distributed.

Here, in so far as a vehicular lighting of Patent Literature 3 is concerned, even if there is used a light focusing lens forming a substantial drum shape (or a barrel shape) as a shape of a front view in which there is provided a trimmed portion resulting from vertically cutting away each of the left and right end parts, a basic shape of which is a circular shape in a front view in terms of a design, a cruising light distribution pattern is obtained in a substantially similar manner to that in the case of a convex lens which is formed in a circular shape as a shape of a front view. However, the vehicular lighting of Patent Literature 3 uses a power discharge bulb; and therefore, in the case of using a semiconductor-type light source such as an incandescent light emitting diode with different light distribution characteristics from those of the power discharge bulb, a light distribution pattern is not obtained in a substantially similar manner to that in the case of the convex lens having a circular front shape, and there may be a case of an increase of the amount of loss in the effectively distributed light that is radiated from the light focusing lens.

A problem to be solved by the present invention is that, in so far as the conventional vehicle lightings are concerned, there may be the case of the increase of the amount of loss in the effectively distributed light that is radiated from the projection lens.

Means for Solving the Problem

The present invention (an invention according to claim 1) includes a semiconductor-type light source; and a projection lens which radiates light from the semiconductor-type light source as a predetermined light distribution pattern. At least at either one of both upper and lower ends of the projection lens, there is provided a trimmed portion resulting from cutting away at least a portion at either one of both upper and lower ends, a basic shape of which is a circular shape or a substantially circular shape in a front view.

The present invention (an invention according to claim 2) includes a feature that a transverse width of a lower portion of a horizontal line passing through a reference optical axis of the projection lens is larger than a transverse width of an upper portion of the horizontal line passing through the reference optical axis of the projection lens, and the transverse width of the lower portion of the horizontal line passing through the reference optical axis of the projection lens and the transverse width of an upper portion of the horizontal line passing through the reference optical axis of the projection lens are larger than transverse widths of the trimmed portions at both upper and lower end parts of the projection lens.

The present invention (an invention according to claim 3) includes a feature that, of the projection lens, an area of a portion lower than the horizontal line passing through the reference optical axis of the projection lens is larger than an area of a portion upper than the horizontal line passing through the reference optical axis of the projection lens.

The present invention (an invention according to claim 4) includes a feature that the trimmed portion of the projection lens forms a linear shape.

The present invention (an invention according to claim 5) includes a feature that the trimmed portion at each of the upper and lower ends of the projection lens forms a linear shape, each of left and right ends on the horizontal line passing through the reference optical axis of the projection lens form a concave corner, and a shape in a front view of the projection lens forms a polygonal shape.

The present invention (an invention according to claim 6) includes a feature that the light distribution pattern is a low-beam light distribution pattern.

Effect of the Invention

In so far as a vehicular lighting of the present invention is concerned, at least at either one of both upper and lower end parts of a projection lens, there is provided a trimmed portion resulting from cutting away at least either one of both the upper and lower end parts, a basic shape of which is a circular shape or a substantially circular shape in a front view. Therefore, a degree of freedom for a design line of a vehicle or a degree of freedom for a layout can be enhanced. Moreover, a portion which is lost (cut away) is mainly each of the upper and lower end parts of a projection lens, and is also an optically inactive portion which is hardly transmitted by the light from a semiconductor-type light source; and an optically active portion which is an intermediate portion of a top and a bottom of the projection lens and which is transmitted by the light from the semiconductor-type light source is a portion at which a loss (cutaway) exerted by the trimmed portion is kept to be as small as possible. As a result, the amount of loss in the effectively distributed light that is radiated from the optically active portion of the projection lens can be restrained to be as small as possible. That is, the light from the semiconductor-type light source can be effectively controlled to be optically distributed.

MODES FOR CARRYING OUT THE INVENTION

Figure 1:
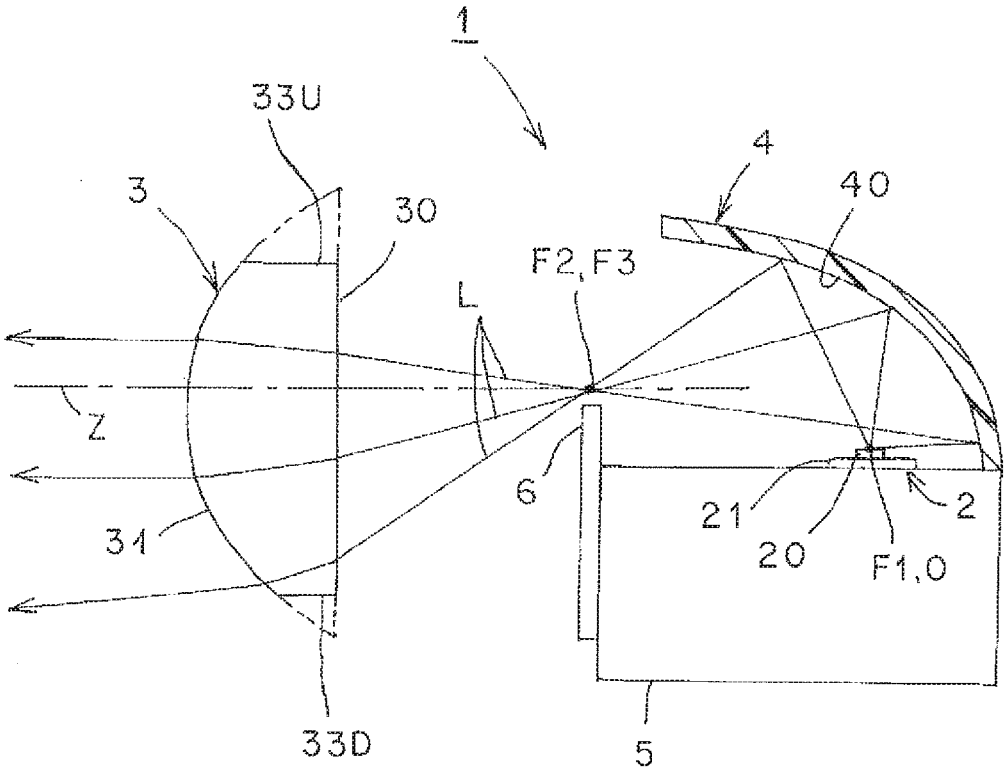
FIG. 1 is a schematic longitudinal cross section (a schematic vertical cross section) showing a first embodiment of a vehicular lighting according to the present invention.

Hereinafter, three examples of the embodiments (exemplary embodiments) of a vehicular lighting according to the present invention will be described in detail with reference to the drawings. It is to be noted that the present invention is not limited by the embodiments. In the present specification and claims attached herewith, the terms "front", "rear", "top", "bottom", "left", and "right" respectively designate the front, rear, top, bottom, left, and right when the vehicular lighting according to the present invention is provided in a vehicle. In addition, in FIG. 5 (A) and FIG. 5 (B), reference numeral "VU-VD" designates a vertical line from the top to the bottom of a screen. Reference numeral "HL-HR" designates a horizontal line from the left to the right of the screen. Further, FIG. 5 (A) and FIG. 5 (B) are explanatory views of an equi-intensity curve of light summarizing and showing a light distribution pattern on a screen mapped by computer simulation. In an explanatory view of this equi-intensity curve of light, an equi-intensity curve of light of the center designates a high intensity of light, and an equi-intensity curve of light of the outside designates a low intensity of light. Further, in FIG. 1, hatchings of cross sections of a lens, a heat sink, and a shade are not shown.

Description of Configuration of First Embodiment

FIG. 1 to FIG. 6 each show a first embodiment of the vehicular lighting according to the present invention. Hereinafter, a configuration of the vehicular lighting in the first embodiment will be described. In this example, a headlamp as a vehicular headlamp will be described, for example.

(Description of Vehicular Lighting 1)

Figure 2:
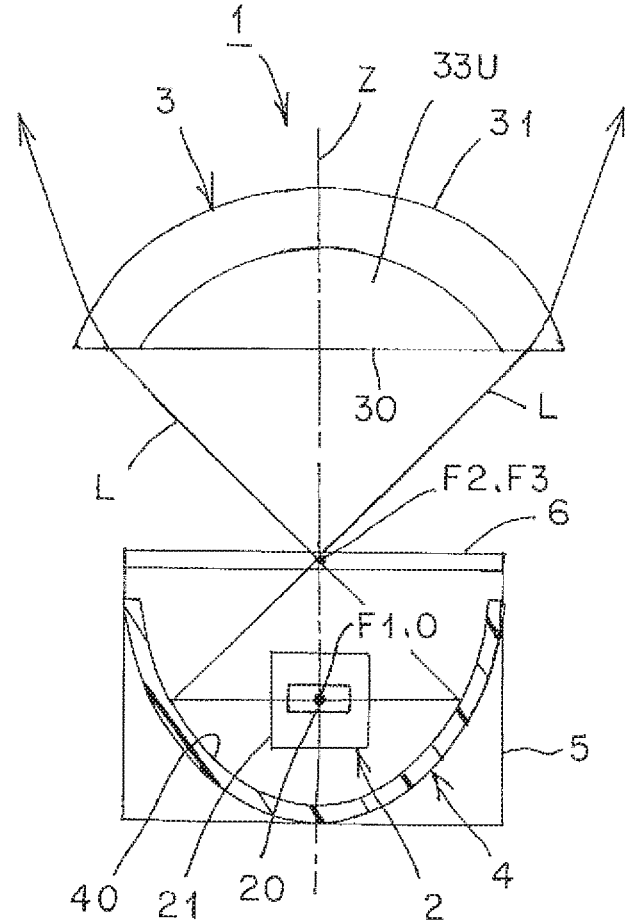
FIG. 2 is a schematic plan view showing a state in which a reflector is seen in a transverse sectional view (a horizontal sectional view).

In the figures, reference numeral 1 designates a vehicular lighting in the first embodiment. The vehicular lighting 1 is mounted at each of the left and right sides at a front part of the vehicle. The vehicular lighting 1, as shown in FIG. 1 and FIG. 2, is provided with: a lamp housing (not shown); a lamp lens (not shown); a semiconductor-type light source 2; a projection lens 3; a reflector 4; a heat sink member 5; and a shade 6.

The lamp housing and the lamp lens (such as a transparent outer lens, for example) define a lamp room (not shown). The semiconductor-type light source 2, the projection lens 3, the reflector 4, the heat sink member 5, and the shade 6 constitute a lamp unit of a projector type. The lamp unit formed by the constituent elements 2, 3, 4, 5, 6 is disposed in the lamp room, and are mounted to the lamp housing via an optical axis adjustment mechanism for vertical direction (not shown) and an optical axis adjustment mechanism for transverse direction (not shown).

(Description of Heat Sink Member 5)

The heat sink member 5 is made of a material with a high heat resistance such as a resin or a metallic die cast (an aluminum die cast), for example. The heat sink member 5 is composed of: an upper horizontal plate portion; and a plurality of fin-shaped portions which are provided to be integral with each other from a bottom face of the horizontal plate portion. The heat sink member 5 is compatible with a mounting member to mount the semiconductor-type light source 2, the projection lens 3, the reflector 4, and the shade 6.

(Description of Reflector 4)

The reflector 4 is made of a material with a high heat resistance and with a light non-transmission property such as a resin member or a metallic die cast (an aluminum die cast), for example. The reflector 4 is mounted to the heat sink member 5. The reflector 4 opens at a front side portion and a lower side portion, and forms a hollow shape which is closed at a rear side portion, at an upper side portion, and at each of the left and right side portions. At a respective one of recessed interior faces of the closed portions of the reflector 4, a reflection surface 40 made of a free curved surface on the basis of a rotational elliptical surface is provided. The reflection surface 40 reflects the light from the semiconductor-type light source 2 as reflection light (L) to the shade 6 and the projection lens 3 side.

The reflection surface 40 is composed of a free curved surface. Thus, at a first focal point F1 and a second focal point (or a second focal line) F2 of the reflection surface 40, single focal points are not respectively provided in a strict sense; and however, a difference in focal point distance between a plurality of reflection surfaces is slight, and focal points which are substantially identical to each other are shared. Therefore, in the present specification and drawings, these focal points are merely referred to as a first focal point and a second focal point. In addition, the reflection surface 40 has a reference optical axis (not shown) to connect the first focal point F1 and the second focal point F2 to each other.

(Description of Semiconductor-Type Light Source 2)

The semiconductor-type light source 2, in this example, is a self-emission semiconductor-type light source such as an LED, an OEL, or an OLED (an organic EL), for example. The semiconductor-type light source 2 is composed of a package (an LED package) in which a light emitting chip (an LED chip) 20 is sealed with a sealing resin member. The package is implemented on a board 21. Via a connector (not shown) which is mounted to the board 21, to the light emitting chip 20, an electric current from a power source (a battery) is supplied. The semiconductor-type light source 2 is mounted to a top face of the horizontal plate portion of the heat sink member 5.

The light emitting chip 20 has a light emission surface which is formed in a rectangular shape. The light emission surface is oriented to an upper side, and opposes to the reflection surface 40 of the reflector 4. A longitudinal direction of the light emission surface is perpendicular to or substantially perpendicular to a reference optical axis (a reference optical axis of the lamp unit formed by the constituent elements 2, 3, 4, 5, 6, a reference optical axis of the reflection surface 40 of the reflector 4, a reference optical axis (a reference axis) Z of the projection lens 3). A center O of the light emission surface is positioned on or near the reference optical axis, and is positioned on or near the first focal point F1 of the reflection surface 40 of the reflector 4.

(Description of Shade 6)

The shade 6 is disposed between: a respective one of the semiconductor-type light source 2 and the reflection surface 40 of the reflector 4; and the projection lens 3, and is mounted to the heat sink member 5. The shade 6 is intended to cut off a part of the reflection light from the reflection surface 40, and the reflection light L that still remains forms a low-beam light distribution pattern LP having cutoff lines CL1, CL2, CL3 shown in FIG. 6.

At an upper end edge of the shade 6, an edge forming the cutoff lines CL1, CL2, CL3 is provided. The edge of the shade 6 forms a linear shape or a curved shape which is taken along a lens focal point (a meridional image surface which is a focal point surface of a material space side, a rear side focal point, a focal line) F3 of the projection lens 3.

(Description of Projection Lens 3)

The projection lens 3 is made of a resin-based lens such as a PC material, a PMMA material, or a PCO material, for example. That is, the light that is radiated from the semiconductor-type light source 2 does not have a high heat and thus a resin-based lens can be used as the projection lens 3. It is to be noted that a glass-based lens other than the resin-based lens may be used as the projection lens 3. The projection lens 3 is mounted to the heat sink member 5 via a holder (not shown).

The projection lens 3 is intended to radiate to the outside, that is, to a front side of the vehicle, the light from the semiconductor-type light source 2, the light being the reflection light from the reflection surface 40 of the reflector 4, the light being the reflection light L that is not cut off by the shade 6, as the low-beam light distribution pattern LP.

The projection lens 3, in this example, is a non-spherical lens. An incidence surface 30 of the projection lens 3 forms a plane or a substantially non-spherical plane (a convex surface or a concave surface with respect to the reflection surface 40). An emission surface 31 of the projection lens 3 forms a convex-shaped non-spherical shape. The projection lens 3 has the reference optical axis Z and the lens focal point F3.

The reference optical axis Z of the projection lens 3 and the reference optical axis of the reflection surface 40 of the reflector 4 are coincident with or substantially coincident with each other. The lens focal point F3 of the projection lens 3 and the second focal point F2 of the reflection surface 40 of the reflector 4 are coincident with or substantially coincident with each other.

Figure 4:
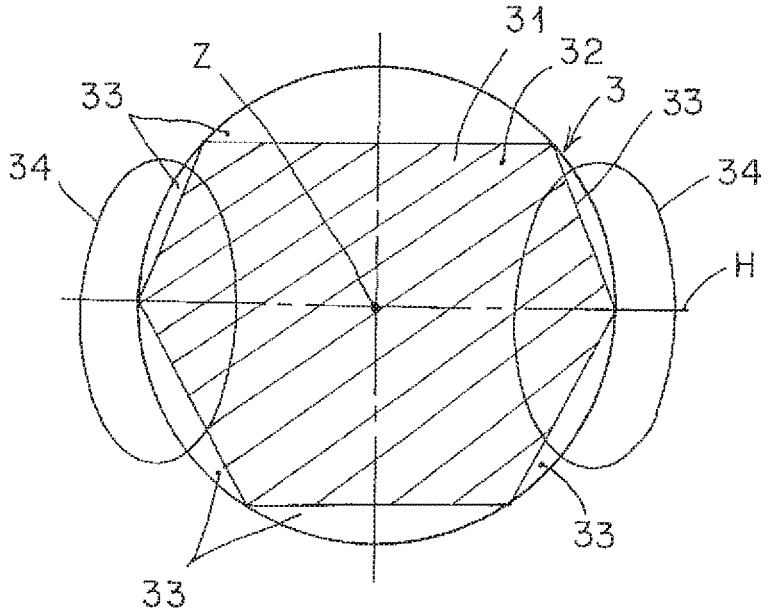
FIG. 4 is an explanatory view showing an optically active portion of the projection lens.

The projection lens 3, as shown in FIG. 4, has: an optically active portion (a portion which is optically active) 32 (refer to the hexagonal portion to which the hatching (solid shading) in FIG. 4 is applied); and an optically inactive portion 33 (refer to six arc-shaped outline portions in FIG. 4).

The optically active portion 32 is a portion which is transmitted by the light from the semiconductor-type light source 2, the light being the reflection light from the reflection surface 40 of the reflector 4, the light being the reflection light L that is not cut off by the shade 6. The optically active portion 32 is an intermediate portion between a top and a bottom of the reflection lens 3.

The optically inactive portion 33 is a portion which is hardly transmitted by the light from the semiconductor-type light source 2, the light being the reflection light from the reflection surface 40 of the reflector 4, the light being the reflection light L that is not cut off by the shade 6. The optically inactive portion 33 is any of the top and bottom portions of the projection lens 3, the left and right portions of the projection lens 3, and an exterior portion of the optically active portion 32.

Figure 5:
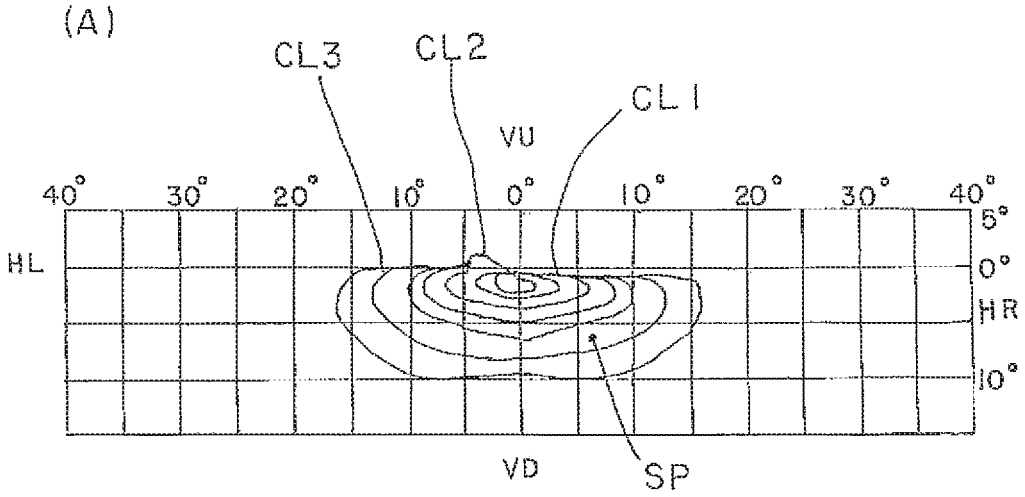
FIG. 5 is an explanatory view showing a focusing light distribution pattern and a scattering light distribution pattern of a low-beam light distribution pattern which is radiated from a lamp unit of a projection type.
Figure 5:
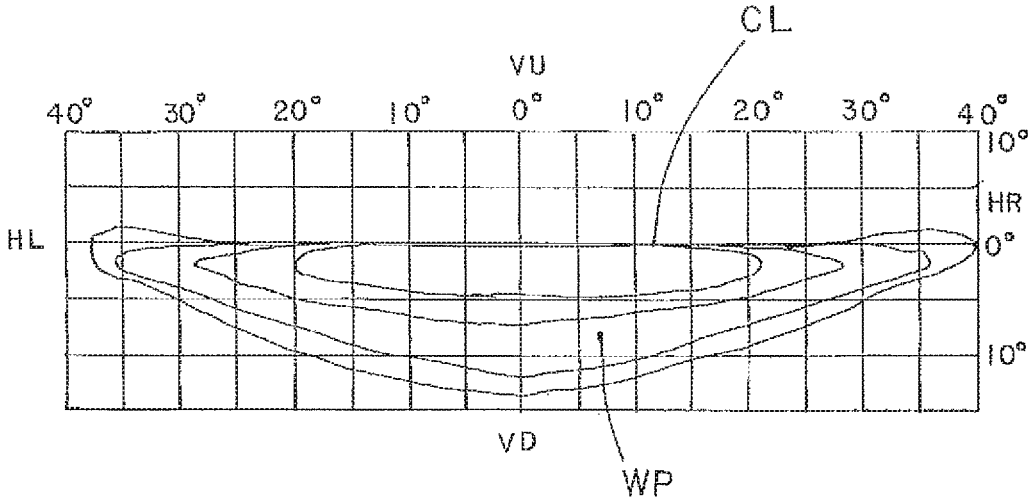

Of the optically active portion 32, in a shape of a front view of the projection lens 3, a portion on or near a horizontal line H passing through the reference optical axis Z of the projection lens 3, as shown in FIG. 2, is a portion which is transmitted by an image of the light emission surface of a rectangular shape of the semiconductor-type light source 2, a longitudinal direction of which is perpendicular to or substantially perpendicular to the reference optical axis Z; and is also a portion which contributes to form a scattered light distribution pattern WP of the low-beam light distribution pattern shown in FIG. 5 (B), of the low-beam light distribution pattern LP. In particular, a portion which is slightly lower than the horizontal line H passing through the reference optical axis Z of the projection lens 3 is a portion which contributes to form the maximum scattering portion of the scattering light distribution pattern WP all over the full width in a front view of the projection lens 3, and is also a portion which is essential to form the low-beam light distribution pattern LP. Thus, it is preferable that the portion that is slightly lower than the horizontal line H passing through the reference optical axis Z of the projection lens 3 be least significantly lost (cut away) by the trimmed portion or the like.

Of the optically active portion 32, in the shape of the front view of the projection lens 3, top and bottom portions other than the portion on or near the horizontal line H passing through the reference optical axis Z of the projection lens 3 are portions which are transmitted by the image of the light emission surface of the rectangular shape of the semiconductor-type light source 2; and are also portions which contribute to form a focusing light distribution pattern SP of the low-beam light distribution pattern shown in FIG. 5 (A), of the low-beam light distribution pattern LP.

Figure 3:
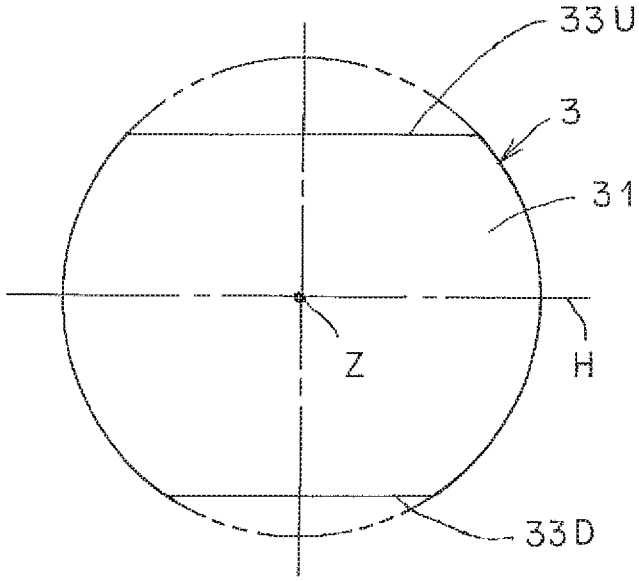
FIG. 3 is a front view (a frontal view) showing a projection lens.

Of the projection lens 3, at portions of both upper and lower end parts, each of which is the optically inactive portion 33, there are respectively provided trimmed portions 33U, 33D resulting from cutting away portions of both the upper and lower end parts, a basic shape of which is a circular shape or a substantially circular shape in a front view (the portions surrounded by the arc of the double-dotted chain lines and solid straight lines in FIG. 1 and FIG. 3). The trimmed portions 33U, 33D each form a linear shape which is parallel to or substantially parallel to the horizontal line H passing through the reference optical axis Z of the projection lens 3.

Of the optically active portion 32, in the shape of the front view of the projection lens 3, a portion at each of the left and right ends on the horizontal line H passing through the reference optical axis Z of the projection lens 3 (the portions surrounded by the ellipses 34 in FIG. 4), as mentioned previously, is a portion on or near the horizontal line H passing through the reference optical axis Z of the projection lens 3, and is also a portion which contribute to form the scattering light distribution pattern WP. In particular, a portion which is slightly lower than the horizontal line H passing through the reference optical axis Z of the projection lens 3 is a portion which contributes to form the maximum scattering portion of the scattering light distribution pattern WP all over the full length in the front view of the projection lens 3, and is also an essential portion for forming the low-beam light distribution pattern LP. Thus, it is preferable that the portion at each of the left and right ends be least significantly lost (cut away) by the trimmed portion.

As shown in FIG. 3, a transverse width of a lower portion of the horizontal line H passing through the reference optical axis Z of the projection lens 3 is larger than a transverse width of an upper portion of the horizontal line H passing through the reference optical axis Z of the projection lens 3. In addition, the transverse width of the lower portion of the horizontal line H passing through the reference optical axis Z of the projection lens 3 and the transverse width of the upper portion of the horizontal line H passing through the reference optical axis Z of the projection lens 3 are larger than transverse widths of the trimmed portions 33U, 33D of both upper and lower ends of the projection lens 3.

As shown in FIG. 1 and FIG. 3, of the projection lens 3, an area of the portion lower than the horizontal line H passing through the reference optical axis Z of the projection lens 3 is larger than an area of the upper portion than the horizontal line H passing through the reference optical axis Z of the projection lens 3. That is, an area of the portion that is cut away by trimmed portion 33U at the upper side (the portions surrounded by the arcs of the double-dotted chain lines and the solid straight lines in FIG. 1 and FIG. 3) is larger than an area of the portion that is cut away by the trimmed portion 33D at the lower side (the portions surrounded by the arcs of the double-dotted lines and the solid straight lines in FIG. 1 and FIG. 3).

Description of Function of First Embodiment

The vehicular lighting in the first embodiment is made of the constituent elements as described above, and hereinafter, functions thereof will be described.

Figure 6:
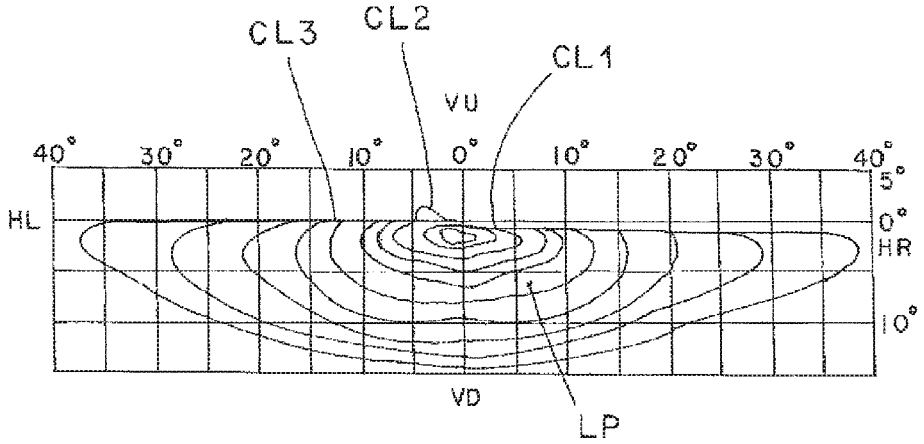
FIG. 6 is an explanatory view showing the low-beam light distribution pattern that is radiated from the lamp unit of the projection type.

The semiconductor-type light source 2 is lit. Afterwards, the light that is radiated from the light emission surface of the light emitting chip 20 of the semiconductor-type light source 2 is reflected to the shade 6 and the projection lens 3 side by the reflection surface 40 of the reflector 4. A part of the reflection light is cut off by the shade 6, and the reflection light L that still remains, as shown in FIG. 6, is radiated to the front side of the vehicle from the projection lens 3, as the low-beam light distribution pattern LP having the cutoff lines CL1, CL2, CL3.

Description of Advantageous Effect of First Embodiment

The vehicular lighting 1 in the first embodiment is made of the constituent elements and functions as described above, and hereinafter, an advantageous effect thereof will be described.

In so far as the vehicular lighting 1 in the first embodiment is concerned, at the portions of both the upper and lower end parts of the projection lens 3, there are respectively provided trimmed portions 33U, 33D resulting from cutting away the portions of both the upper and lower end parts, the basic shape of which is the circular shape or the substantially circular shape in the front view (the portions surrounded by the arcs of the double-dotted chain lines and the solid straight lines in FIG. 1 and FIG. 3). In addition, the trimmed portions 33U, 33D each form a linear shape which is parallel to or substantially parallel to the horizontal line H passing through the reference optical axis Z of the projection lens 3. Thus, the degree of freedom for the design line of the vehicle or the degree of freedom for the layout can be enhanced.

Moreover, in so far as the vehicular lighting 1 in the first embodiment is concerned, a portion which is lost (cut away) by a respective one of the trimmed portions 33U, 33D is mainly each of the upper and lower end parts of the projection lens 3, and is also an optically inactive portion 33 which is hardly transmitted by the light from the semiconductor-type light source 2, and further, an optical active portion 32 which is an intermediate portion between the top and the bottom of the projection lens 3 and which is transmitted by the light from the semiconductor-type light source 3 is restrained with respect to the loss (cutaway) exerted by the respective one of the trimmed portions 33U, 33D. As a result, the amount of loss in the effectively distributed light that is radiated from the optically active portion 32 of the projection lens 3 can be restrained to be as small as possible. That is, the light from the semiconductor-type light source 2 can be effectively controlled to be optically distributed.

In so far as the vehicular lighting 1 in the first embodiment is concerned, of the optically active portion 32 of the projection lens 3, in the shape of the front view of the projection lens 3, the portion of each of the left and right ends on the horizontal line H passing through the reference optical axis Z of the projection lens 3 (the portions surrounded by the ellipses 34 in FIG. 4) is not cut away by the respective one of the trimmed portions or the like. Thus, the low-beam light distribution pattern LP having the cutoff lines CL1, CL2, CL3 shown in FIG. 6 can be effectively formed and radiated to the front side of the vehicle.

That is, of the optically active portion 32 of the projection lens 3, the portion of each of the left and right ends on the horizontal line H passing through the reference optical axis Z of the projection lens 3 (the portions surrounded by the ellipses 34 in FIG. 4) is a respective one of the portions on and near the horizontal line H passing through the reference optical axis Z of the projection lens 3, and is also a portion which contributes to form the scattering light distribution pattern WP. In particular, a portion which is slightly lower than the horizontal line H passing through the reference optical axis Z of the projection lens 3 is a portion which contributes to form the maximum scattering portion of the scattering light distribution pattern WP all over the full width in the front view of the projection lens 3, and is also a portion which is essential to form the low-beam light distribution pattern LP. Thus, it is preferable that, of the optically active portion 32 of the projection lens 3, the portion of each of the left and right ends on the horizontal line H passing through the reference optical axis Z of the projection lens 3 (the portions surrounded by the ellipses 34 in FIG. 4) be least significantly lost (cut away) by the respective one of the trimmed portions or the like.

In so far as the vehicular lighting 1 in the first embodiment is concerned, as shown in FIG. 1 and FIG. 3, of the projection lens 3, the area of the portion lower than the horizontal line H passing through the reference optical axis Z of the projection lens 3 is larger than the area of the upper portion than the horizontal line H passing through the reference optical axis Z of the projection lens 3. Thus, the equi-intensity curve of light of the outside of the focusing light distribution pattern SP of the low-beam light distribution pattern LP (that is, the scattering portion of the focusing light distribution pattern SP) and the equi-intensity curve of light of the scattering light distribution pattern WP of the low-beam light distribution pattern LP are smoothly connected to each other, and an appropriate low-beam light distribution pattern LP is obtained.

Figure 7:
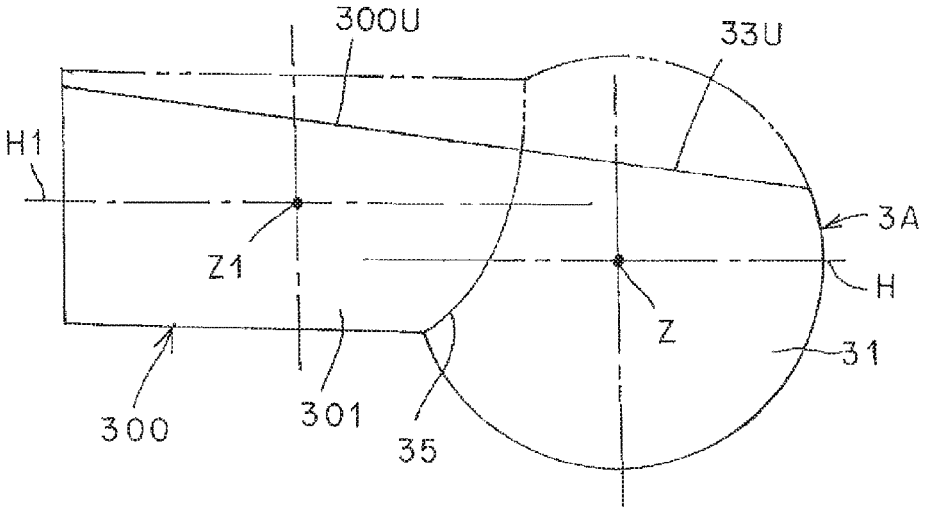
FIG. 7 is a front view (a frontal view) of a projection lens and a cylindrical lens showing a second embodiment of the vehicular lighting according to the present invention are constructed to be integral.

Description of Configuration, Functions, and Advantageous Effect of Second Embodiment FIG. 7 shows a second embodiment of the vehicular lighting according to the present invention. Hereinafter, the vehicular lighting in the second embodiment will be described. In the figure, the same reference numerals of FIG. 1 to FIG. 6 designate the same constituent elements.

The vehicular lighting of the second embodiment is provided with: a first lamp unit having a projection lens 3A; and a second lamp unit having a cylindrical lens 300. The first lamp unit forms a construction which is substantially similar to that of the vehicular lighting 1 in the first embodiment. That is, a shape of the projection lens 3A of the first lamp unit and a shape of the projection lens 3 of the vehicular lighting 1 in the first embodiment are slightly different from each other.

As shown in FIG. 7, the projection lens 3A and the cylindrical lens 300 are constructed to be integral with each other in a state in which a reference optical axis Z1 of the cylindrical lens 300 is displaced to an upper side with respect to a reference optical axis Z of the projection lens 3A, via a connection line 35. A vertical dimension of the cylindrical lend 300 is smaller than a vertical dimension of the projection lens 3A. At upper parts of the projection lens 3A and the cylindrical lens 300 that are constructed to be integral with each other, trimmed portions 33U and 300U are respectively provided. The trimmed portions are made of: the trimmed portion 33U resulting from cutting away an upper part, a basic shape of which is a substantially circular shape in the front view (the portion surrounded by the arc of the double-dotted chain line and the solid line in FIG. 7); and a trimmed portion 300U resulting from cutting away an upper part, a basic shape of which is a substantially rectangular shape in a front view (the upper part surrounded by the straight line of the double-dotted chain line and the solid straight line in FIG. 7). The trimmed portions 33U, 300U each form a linear shape which is inclined from the top to the bottom from the projection lens 3A to the cylindrical lens 300.

The vehicular lighting of the second embodiment is made of the constituent elements as described above, and hereinafter, functions thereof will be described. That is, from an emission surface 31 of the projection lens 3A of the first lamp unit and an emission surface 301 of the cylindrical lens 300 of the second lamp unit, a low-beam light distribution pattern LP having the cutoff lines CL1, CL2, CL3 shown in FIG. 6 is radiated to the front side of the vehicle.

The vehicular lighting of the second embodiment is made of the constituent elements as described above and thus an advantageous effect which is substantially similar to that of the vehicular lighting 1 in the first embodiment can be achieved. That is, at upper parts of the projection lens 3A and the cylindrical lens 300 that are constructed to be integral with each other, trimmed portions 33U and 300U are respectively provided. The trimmed portions 33U, 300U each form a linear shape which is inclined from the top to the bottom from the projection lens 3A to the cylindrical lens 300. Thus, the degree of freedom for the design line of the vehicle and the degree of freedom for the layout can be enhanced. Moreover, a vehicular lighting having a novel appearance can be provided.

Moreover, in so far as the vehicular lighting of the second embodiment is concerned, even if the trimmed portions 33U and 300U are respectively provided at the upper parts of the projection lens 3A and the cylindrical lens 300 that are constructed to be integral with each other, an optically active portion (32) of the projection lens 3A is hardly lost (cut away) by the trimmed portion 33U, and if this portion is lost (cut away), the lost (cut away) portion is kept to be as small as possible. Thus, the amount of loss in the effectively distributed light that is radiated from the optical active portion (32) of the projection lens 3A can be restrained to be as small as possible. That is, the light from the semiconductor-type light source (2) can be effectively controlled to be optically distributed.

Further, in so far as the vehicular lighting of the second embodiment is concerned, the reference optical axis Z1 of the cylindrical lens 300 is positioned to be upper than the reference optical axis Z of the projection lens 3, whereby, of the optical active portion (32) of the projection lens 3A, an overlapping portion between a lower portion of a horizontal line H passing through the reference optical axis X and a lower portion of a horizontal line H1 passing through the reference optical axis Z1 of the cylindrical lens 300 is small. Thus, an equi-intensity curve of light of the outside of a focusing light distribution pattern SP of a low-beam distribution pattern LP (that is, a scattering portion of the focusing light distribution pattern SP) and an equi-intensity curve of light of a scattering light distribution pattern WP of the low-beam light distribution pattern are smoothly connected to each other, and an appropriate low-beam light distribution pattern LP is obtained.

Figure 8:
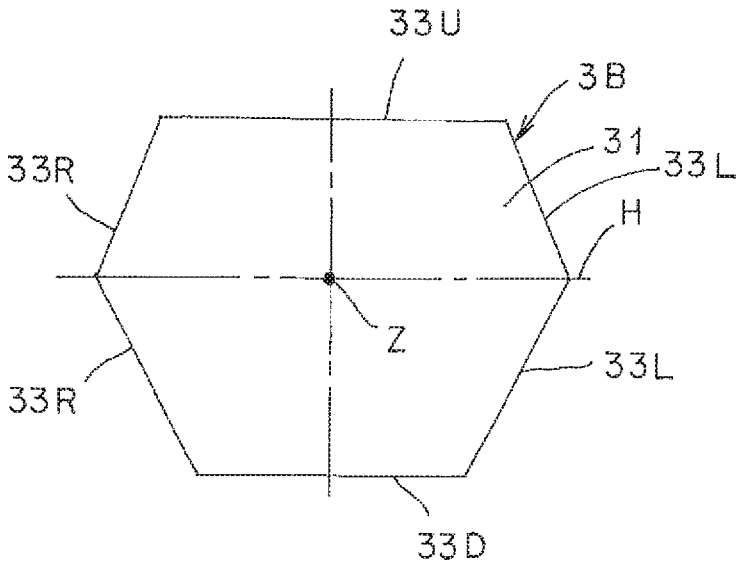
FIG. 8 is a front view (a frontal view) of a hexagonally shaped projection lens showing a third embodiment of the vehicular lighting according to the present invention

Description of Configuration, Functions, and Advantageous Effect of Third Embodiment FIG. 8 shows a third embodiment of the vehicular lighting according to the present invention. Hereinafter, the vehicular lighting in the third embodiment will be described. In the figure, the same reference numerals of FIG. 1 to FIG. 7 designate the same constituent elements.

In so far as the vehicular lighting of the third embodiment is concerned, a shape in a front view of a projection lens 3B forms a hexagonal shape by trimmed portions 33U, 33D, 33L, 33R. That is, at both upper and lower end parts of the projection lens 3B, the trimmed portions 33U, 33D of the first embodiment are respectively provided. At both the left and right end parts of the projection lens 3B, there are respectively provided: trimmed portions 33L, 33R resulting from cutting away portions of both the left and right end parts, a basic shape of which is a circular shape in a front view (the portions surrounded by the arcs and straight lines in FIG. 4). The trimmed portions 33U, 33D, 33L, 33R each form a linear shape.

In so far as the vehicular lighting of the third embodiment is concerned, the shape in the front view of the projection lens 3B forms the hexagonal shape and thus the degree of freedom for the design line of the vehicle and the degree of freedom for the layout can be enhanced. Moreover, a vehicular lighting having a novel appearance can be provided.

Moreover, in so far as the vehicular lighting of the third embodiment is concerned, even if the projection lens 3B is cut away in a hexagonal shape in a front view, an optical active portion (32) of the projection lens 3B is hardly lost (cut away) by the trimmed portions 33U, 33D, 33L, 33R, and even if this portion is lost (cut away), the lost (cut away) portion is kept to be as small as possible. Thus, the amount of loss in the effectively distributed light that is radiated from the optical active portion (32) of the projection lens 3B can be restrained to be as small as possible. That is, the light from the semiconductor-type light source (2) can be effectively controlled to be optically distributed.

Description of Examples Other than First, Second, and Third Embodiments

Incidentally, the first, second, and third embodiments described the headlamp to radiate the low-beam light distribution pattern LP. However, in the present invention, it may be that the shade 6 is made mobile so as to switch and radiate a low-beam light distribution pattern and a high-beam light distribution pattern or any other light distribution pattern.

In addition, the first, second, and third embodiments described the headlamp that radiates the low-beam light distribution pattern. However, in the present invention, it may be that a light distribution pattern other than the low-beam light distribution pattern, for example, a high-beam light distribution pattern is radiated without the shade 6 or that any other light distribution pattern is radiated irrespective of whether the shade 6 is present or absent.

Further, in the first, second, and third embodiments, the lamp unit of the projection type was used. However, in the present invention, there may be used a lamp unit other than the lamp unit of the projection type, for example, a lamp unit of a lens direct emission type.

Furthermore, in the first, second, and third embodiments, the longitudinal direction of the rectangular light emission surface of the light emitting chip 20 of the semiconductor-type light source 2 was perpendicular to or substantially perpendicular to the reference optical axis (the reference optical axis of the lamp unit formed by the constituent elements 2, 3, 4, 5, 6, the reference optical axis of the reflection surface 40 of the reflector 4, the reference optical axis (the reference axis) Z of the projection lens 3), and the low-beam pattern LP having the cutoff lines CL1, CL2, CL3 shown in FIG. 6 was formed. However, in the present invention, it may be that the longitudinal direction of the light emission face is parallel to or substantially parallel to a reference optical axis, and the focusing light distribution pattern SP for the low-beam light distribution pattern having the cutoff lines CL1, CL2, CL3 shown in FIG. 5 (A) is formed. In addition, it may be that the scattering light distribution pattern WP for the low-beam light distribution pattern having the cutoff line CL shown in FIG. 5 (B) is formed.

Still furthermore, in the first, second, and third embodiments, the trimmed portions each formed a linear shape. However, in the present invention, a trimmed portion may be in a shape other than the linear shape, for example, a curved shape, a wavy shape, a concave shape, a convex shape or the like.

Yet furthermore, in the third embodiment, the shape in the front view of the projection lens 3B formed the hexagonal shape by the trimmed portions 33U, 33D, 33L, 33R. However, in the present invention, a shape in a front view of a projection lens may be a polygonal shape other than the hexagonal shape (a triangular shape, a rectangular shape, a pentagonal shape, a septal or more polygonal shape).

DESCRIPTION OF REFERENCE NUMERALS

1 Vehicular lighting
2 Semiconductor-type light source
20 Light emitting chip
21 Board
3, 3A, 3B Projection lenses
30 Incident surface
31 Emission surface
32 Optically active portion
33 Optical inactive portion
33U, 33D, 33L, 33R, 300U Trimmed portions
34 Ellipse surrounding portion of each of left and right ends
35 Connection line
4 Reflector
40 Reflection surface
5 Heat sink member
6 Shade
CL, CL1, CL2, CL3 Cutoff lines
F1 First focal point
F2 Second focal point
F3 Focal point of lens
H Horizontal line
HL-HR Horizontal line from left to right of screen
L Reflection light
LP Low-beam light distribution pattern
O Center
SP Focusing light distribution pattern
VU-VD Vertical line from top to bottom of screen
WP Scattering light distribution pattern
Z Reference optical axis of projection lens
Z1 Reference optical axis of cylindrical lens

The invention claimed is:

1. A vehicular lighting, comprising:

a semiconductor-type light source; and a projection lens which radiates light from the semiconductor-type light source as a predetermined light distribution pattern, wherein the projection lens includes an optically active portion which transmits light from the semiconductor-type light source and an optically inactive portion which hardly transmits light from the semiconductor-type light source, the projection lens being provided with a trimmed portion provided by cutting away a portion at the optically inactive portion, and wherein the optically active portion is not provided with the trimmed portion.

2. The vehicular lighting according to claim 1, wherein a transverse width of a lower portion of a horizontal line passing through a reference optical axis of the projection lens is larger than a transverse width of an upper portion of the horizontal line passing through the reference optical axis of the projection lens, and wherein the transverse width of the lower portion of the horizontal line passing through the reference optical axis of the projection lens and the transverse width of the upper portion of the horizontal line passing through the reference optical axis of the projection lens are larger than transverse widths of the trimmed portions respectively at upper and lower end parts of the projection lens.

3. The vehicular lighting according to claim 1, wherein, of the projection lens, an area of a portion lower than a horizontal line passing through a reference optical axis of the projection lens is larger than an area of a portion higher than the horizontal line passing through the reference optical axis of the projection lens.

4. The vehicular lighting according to claim 1, wherein the trimmed portion of the projection lens forms a linear shape.

5. The vehicular lighting according to claim 1, wherein the trimmed portion at each of upper and lower ends of the projection lens forms a linear shape, wherein each of left and right ends on a horizontal line passing through a reference optical axis of the projection lens form a concave corner, and wherein a shape in a front view of the projection lens forms a polygonal shape.

6. The vehicular lighting according to claim 1, wherein the light distribution pattern is a low-beam light distribution pattern.

7. The vehicular lighting according to claim 1, wherein a primary shape of the portion to be cut away at the optically inactive portion is a circular shape or a substantially circular shape in a front view.

8. The vehicular lighting according to claim 1, further comprising:

a reflector which reflects the light from the semiconductor-type light source to the projection lens; and a shade provided between the reflector and the semiconductor-type light source to cut off a portion of the light reflected by the reflector, wherein the optically inactive portion is a portion which hardly transmits the light which is emitted from the semiconductor-type light source, then reflected by the reflector and not cut off by the shade, and the optically active portion is a portion which transmits the light which is emitted from the semiconductor-type light source, then reflected by the reflector, and not cut off by the shade.

9. The vehicular lighting according to claim 1, wherein the optically inactive portion is any of top and bottom portions of the projection lens, left and right portions of the projection lens, and an exterior portion of the optically active portion, and the optically active portion is an intermediate portion between a top and a bottom of the reflection lens.

10. The vehicular lighting according to claim 1, wherein the trimmed portion results from cutting away the portion at at least one of upper and lower end parts of the projection lens.

* * * * *